US005979749A

United States Patent [19]

Bozich

[11] Patent Number: 5,979,749

[45] Date of Patent: Nov. 9, 1999

[54] COMBINATION SHIPPING AND POINT OF SALE DISPLAY CARTONS FOR CONSUMER GOODS

[75] Inventor: Michael D. Bozich, Broadview Hts., Ohio

[73] Assignee: The Glidden Company, Cleveland, Ohio

[21] Appl. No.: 09/157,053

[22] Filed: Sep. 18, 1998

[51] Int. Cl.[6] ..... B65D 5/54

[52] U.S. Cl. ..... 229/235; 229/160.2; 229/164; 229/242

[58] Field of Search ..... 229/160.2, 164, 229/235, 239, 240, 242; 206/736, 738, 746, 774

[56] References Cited

U.S. PATENT DOCUMENTS

| | | | |
|---|---|---|---|
| 2,447,096 | 8/1948 | Schneider | 229/235 |
| 2,547,892 | 4/1951 | Stevens | 229/242 |
| 2,909,312 | 10/1959 | Conerty | 229/235 |
| 2,967,610 | 1/1961 | Ebert et al. | 229/235 |
| 3,090,483 | 5/1963 | Altree et al. | 229/235 |
| 3,136,474 | 6/1964 | Schaus et al. | 229/235 |
| 4,605,128 | 8/1986 | Rieke | 229/242 |
| 4,746,010 | 5/1988 | Fournier | 229/235 |
| 4,784,271 | 11/1988 | Wosaba, II et al. | 229/235 |
| 4,865,187 | 9/1989 | Zulauf et al. | 229/235 |
| 5,505,372 | 4/1996 | Edson et al. | 229/235 |
| 5,507,432 | 4/1996 | Cyr | 229/235 |

FOREIGN PATENT DOCUMENTS

| | | | |
|---|---|---|---|
| 2238776 | 6/1991 | United Kingdom | 229/235 |

*Primary Examiner*—Gary E. Elkins
*Attorney, Agent, or Firm*—Thomas M. Schmitz

[57] ABSTRACT

A combination shipping and display carton for shipping goods in a conventional manner, but adapted to remove the top to convert the shipping carton to an inventory carton suitable for stacking vertically in a point of sale display. The shipping carton is further adapted to remove a portion of the front panel of the carton to expose goods inside the carton and convert the carton to a display carton.

7 Claims, 1 Drawing Sheet

COMBINATION SHIPPING AND POINT OF SALE DISPLAY CARTONS FOR CONSUMER GOODS

This invention pertains to a combination shipping and display carton particularly useful for stacking vertically for inventory purposes and then later easily converted to a display carton. The first step removes the lid from the shipping carton but maintains the side panels integral for carton strength purposes to provide an inventory carton useful in a mass merchandizing multiple layer stacking system without destroying or damaging the underneath cartons. The second step removes part of the front panel from the top inventory carton to convert to a display carton and provide full view of the labeled goods inside the display carton for easy access by consumers.

BACKGROUND OF THE INVENTION

The rapid growth in warehouse merchandizing home centers has considerably increased the demand for employees to stock goods in large volume inventory as part of the point of sale display. The mass merchandizing concepts emphasize minimal handling of goods to expedite inventory turn over but provide accessibility to the consumer for purchasing retail goods. Mass merchandizing requires creative packaging design to minimize retail handling of supplied goods and particularly to assist the retailer with consumer friendly display cartons structurally sound for shipping and stacking, but adaptable to provide an attractive display of goods in the shipping carton at the point of sale. This concept is particularly useful for shipping and displaying upright containers of consumer products which can be exposed for convenient selection by consumers. In essence, the procedure for stacking of cartons in retail space as inventory and then rehandling of the same carton when it emerges as the display carton needs to be simplified.

It now has been found that a structurally sound shipping carton can be received by the retailer and stacked in multiple layers for inventory purposes but then readily converted to a display carton without moving the carton. The shipping display cartons of this invention can be converted to a display carton by a two step procedure where sections of the shipping carton are removed as the carton progresses from a stacked inventory carton to a top display carton in the stack. The multi-step procedure consists of first totally removing the top lid of the shipping carton to produce an opened inventory carton for stacking purposes on the retail floor space. The second step subsequently removes a portion of the front panel of the carton as the beneath carton becomes the top exposed consumer display carton. Removal of part of the front panel provides for consumer viewing of upright orientated brand labeled consumer goods inside the carton.

Each shipping carton contains separation means in the vertical walls of the carton to provide expedient separation and removal of the top lid to convert the shipping carton to an inventory carton while still maintaining the structural integrity of the carton. The separation means can consist of lateral perforations or a lateral tear tape circumventing the shipping carton near the top lid to enable efficient removal of the carton top lid. A set format of perforations located in the front panel of the carton provides a perforated section in the front panel easily removed to expose brand name consumer products inside the carton. The predesignated removal sections eliminate the need for utility knives or other external opening implements.

In accordance with this invention, a retail merchandiser can receive a shipment of cartons from the supplier and progressively remove sections of each carton as needed. The shipping cartons become inventory cartons and can be stacked or displayed in multiple vertical tiers without compromising the structural integrity of each carton regardless of vertical location in the stacking. The stacked inventory cartons maintain the consumer products within the inventory carton protected from dislodging and spills due to inadvertent bumps and knocks from people passing by. As inventory cartons move to primary retailing sell positions within the display, the perforated front panel section can be removed free of the carton to convert the inventory carton into a consumer display carton and provide essentially full view and free access to the goods by the consumer. The zip and pop structural features of the carton enables retailers, especially mass retailers, to receive shipments of cartons structurally sound for stacking but easily adapted for display of the consumer goods within the same carton. Unsafe utility knives are not required and stacked cartons need not be moved again to a point of display. The shipping display carton reduces stock damage and minimizes loss of time due to clean up. These and other advantages will become more apparent by referring to the drawings and detailed description of the invention.

SUMMARY OF THE INVENTION

Briefly, the combined shipping and display carton of this invention comprises a carton having a top, a bottom, and at least three and preferably four vertical panels, including a front panel, where the carton is adapted with tear separation means to provide a two step quick separation of two designated sections of the carton to convert the shipping carton into a display carton. The first step separates the top lid from the rest of the shipping carton to convert the shipping carton into a structurally stable inventory carton suitable for vertically stacking with similar cartons without damaging the lower cartons. The second step removes a portion of the front panel of the top carton to convert the top inventory carton into a consumer display carton. The integrity of the carton structure is maintained during shipping and display while facilitating the exposure of goods in the final consumer display carton.

DETAILED DESCRIPTION OF THE INVENTION

Figure 1:
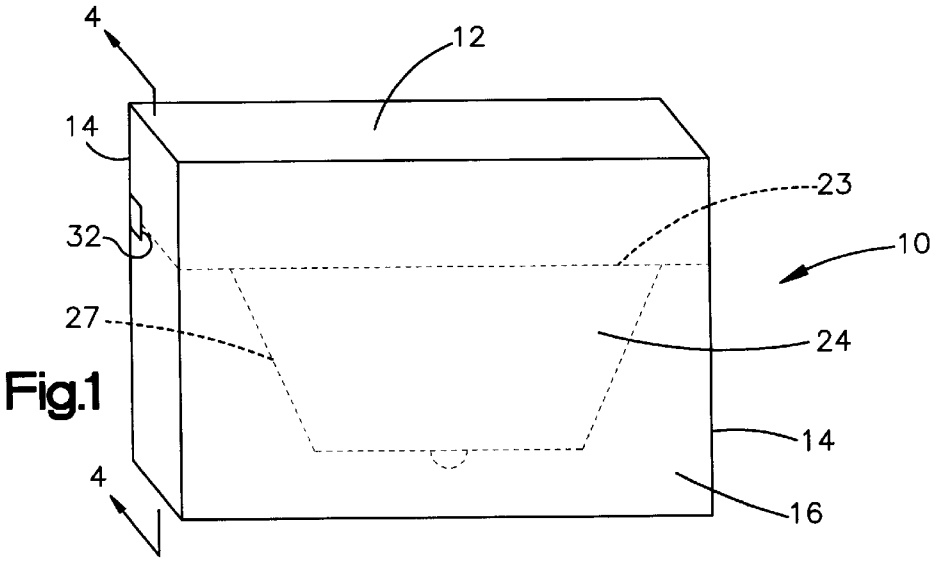
FIG. 1 is a vertical perspective drawing of the shipping and display carton of this invention.

Referring now to the drawings wherein like reference characters indicate like parts, shown is the shipping display carton 10 of this invention made from formed cardboard material fabricated into a box shape with interconnecting panels consisting of a top area 12, a bottom area 13, two vertical side panels 14,14, a vertical front panel 16, and a vertical rear panel 18. In accordance with this invention, the carton 10 is integral when supplied as a shipping and display carton, as shown in FIG. 1, but is adapted with a tear off top lid 20 to provide an inventory carton 40, as shown in FIG. 2, and further adapted with a tear open frontal section 24 of the front panel 16 to provide a point of display carton 50, as shown in FIG. 3.

Figure 2:
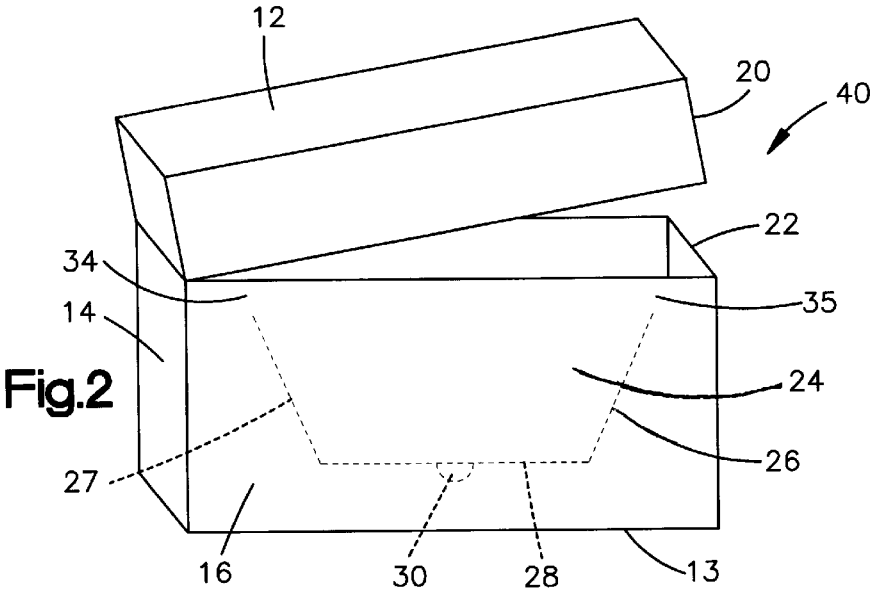
FIG. 2 is the carton in FIG. 1 with the top of the carton partially removed to convert the shipping carton into an inventory carton.
Figure 4:
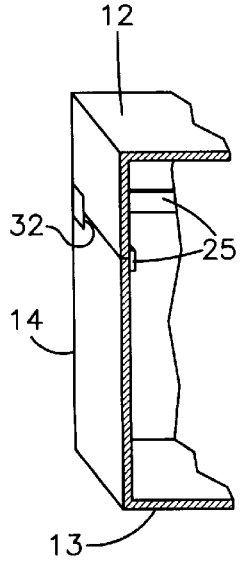
FIG. 4 is a partial vertical section view taken along lines 4—4 in FIG. 1 to provide a partial inside view of the carton shown in FIG. 1.
Figure 3:
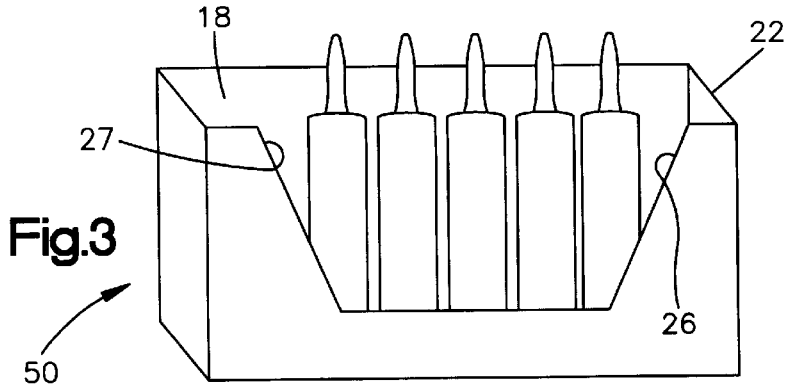
FIG. 3 is the carton in FIG. 1 with the top and a partial section of the front panel removed to convert the carton into a display carton and expose consumer goods inside the carton.

To enable conversion from a shipping carton 10 to an inventory carton 40, a tear line means operative to separate the top lid 20 from the carton 10 can be pulled laterally along a tear line 22 to separate the top lid 20, as shown in FIG. 2, to provide an inventory stacking carton 40 sufficiently strong for vertical stacking in retailing floor space. The tear line 22 may comprise a plurality of laterally orientated continuous linear perforations 23 to facilitate opening of the tear line 22. The tearline means preferably comprises a continuous tear tape or cord 25, best shown in FIG. 4, secured to the inside surface of the carton 10 sidewalls 14, 14, 16, 18 along tear line 22 laterally circumventing the inside of the carton 10. Access to the tear tape 25 secured inside the carton 10 is provided by a perforated finger insert opening 32 disposed in the left sidewall panel 14 in FIG. 1. The inside tear tape 25 can be finger gripped from the outside and torn laterally along the tear line 22 to separate the top lid 20 from the carton 10 and convert the carton into an inventory carton 40.

In accordance with this invention, a removable partial section 24 of the front panel 16 of the carton 10 is defined by tear lines consisting of continuous perforated lines comprising opposed vertically orientated linear perforations 26, 27 which interconnect at the bottom with interposed lateral bottom linear perforations 28. Preferably the removable section 24 is laterally centered in the front panel 16 and comprises a major portion of the front panel 16. The removable front partial section 24 is adapted to be torn open along bottom lateral perforation line 28 and upwardly along opposed vertically orientated perforation lines 26, 27 to provide a pop open removable section 24 from the front panel 16. Adjacently below bottom lateral perforations 28, the front panel 16 contains a thumb insert pull opening 30 to facilitate gripping of the removable front section 24 for tear open removal from the front panel 16. The vertically disposed perforated lines 26 and 27 can intersect with the upper lateral tear line 22, as shown in FIG. 1, but preferably stop below the lateral tear line 22, as shown in FIG. 2, to provide integral nonperforated spacings 34 and 35 which provide added strength to the display carton 50 before the partial section 24 is removed. Spacings 34 and 35 respectively are disposed between tear line 22 and the upper distal ends of vertical perforation lines 26 and line 27 respectively.

In accordance with this invention, consumer goods can be shipped to a merchandiser in a secure carton 10. Upon receipt, the carton 10 can be transported directly to the merchandiser's retail space where each carton 10 is first opened by gripping the tear means tape 25 through the finger opening 32 and tearing the tape 25 laterally along the tear line 22 to separate and remove the top lid 20 from the carton 22, as indicated in FIG. 2. Removal of the top lid 20 converts the shipping carton 10 to an inventory carton 40 where multiple open cartons 40 can be stacked vertically on the retail space floor without damaging lower cartons. When each lower inventory carton 40 reaches the top of the display, the removable front section 24 of the front panel 16 can be similarly torn open and removed to convert the inventory carton 40 to a consumer display carton 50, which exposes labeled goods inside the display carton 50 as indicated in FIG. 3. Hence, the original shipping display carton 10 can be expediently transferred directly to floor retail space, opened, and stacked vertically while maintaining integrity of the stacked cartons, whereupon the top carton can be further opened by removing part of the front panel for consumer access, all without moving the original stacked cartons.

Although the merits of the combined shipping display carton of this invention have been described and illustrated in the drawings in respect to referred embodiments, the invention is not intended to be limited except by the appended claims.

I claim:

1. A combination shipping/display carton, comprising:

a shipping container carton having a top structure, a bottom structure, and a plurality of interconnecting vertical panels connected between the top and bottom structures, where one of the vertical panels is a front panel;

the shipping carton having a peripheral tearing means circumventing the vertical panels proximate the top structure for separating the top structure from the vertical panels to open and convert the shipping carton to a stacking inventory carton;

the front panel of the shipping carton having a removable section defined by linear perforations and adapted to be separated by tearing along designated perforations in the front panel and removing the removable section from the front panel to convert the inventory carton to a display carton;

where the removable section defined by perforated lines in the front panel comprises a majority of the area of the front panel and is in the shape of an inverted truncated triangle; and where the perforations defining the removable section are downwardly spaced from the peripheral tearing means circumventing the vertical panels to maintain carton integrity after the top structure is removed.

2. The shipping/display carton in claim 1 where vertical panels consist of four vertical panels and the peripheral tearing means circumvents the four vertical panels horizontally, and where the tearing means comprises a continuous substantially straight tearline structure adapted to separate the top structure from the four vertical panels.

3. The shipping/display carton of claim 1 where the tearing means contains laterally directed linear perforations to facilitate tearing and removing of the top structure from the vertical panels.

4. The shipping/display carton of claim 1 where the tearing means contains a finger grip means for accessing and gripping the tearing means to facilitate separation of the top structure from the vertical panels.

5. The shipping/display carton of claim 1 where the front panel contains an insert opening adjacently below the removable section for gripping, tearing and separating the removable section from the front panel.

6. The shipping/display carton of claim 1 where the removable section is laterally centered in the front panel.

7. A combination shipping/display carton, comprising:

a shipping container carton having a top structure, a bottom structure, and four interconnecting vertical panels connected between the top and bottom structures, where one of the vertical panels is a front panel;

the shipping carton having a peripheral tearing means circumventing the vertical panels horizontally proximate the top structure for separating the top structure from the vertical panels to open and convert the shipping carton to a stacking inventory carton;

the front panel of the shipping carton having a removable section defined by linear perforations and adapted to be separated by tearing along designated perforations in the front panel to convert the inventory carton to a display carton;

where the removable section defined by perforated lines in the front panel comprises a majority of the area of the front panel, and where the perforations defining the removable section are downwardly spaced from the peripheral tearing means circumventing the vertical panels to maintain carton integrity after the top structure is removed.

* * * * *